US005295775A

United States Patent [19]

Andjelic et al.

[11] Patent Number: 5,295,775

[45] Date of Patent: Mar. 22, 1994

[54] METHOD OF AND APPARATUS FOR MAKING BOOKS

[75] Inventors: Milan Andjelic; Jens Pünner, both of Hamburg; Siegfried Lampe, Ellerbek, all of Fed. Rep. of Germany

[73] Assignee: E. C. H. Will GmbH, Hamburg, Fed. Rep. of Germany

[21] Appl. No.: 988,459

[22] Filed: Dec. 10, 1992

[30] Foreign Application Priority Data

Dec. 18, 1991 [DE] Fed. Rep. of Germany ..... 4141767

[51] Int. Cl.[5] ..... B42C 9/00; B42C 11/04

[52] U.S. Cl. ..... 412/2; 412/4; 412/8; 412/16; 412/19; 412/22; 412/35; 412/37

[58] Field of Search ..... 412/2, 4, 6, 8, 16, 412/19, 21, 22, 26, 28, 35, 37

[56] References Cited

U.S. PATENT DOCUMENTS

| | | | |
|---|---|---|---|
| 1,777,448 | 10/1930 | Rader | 412/2 |
| 2,322,647 | 6/1943 | Luce | 412/2 X |
| 2,645,795 | 7/1953 | Pitner | 412/2 |
| 4,151,037 | 4/1979 | Klingelhoefer | 156/477 B |
| 4,334,608 | 6/1982 | Fabrig | 198/650 |
| 4,484,501 | 11/1984 | Ramcke | 412/2 X |
| 4,629,058 | 12/1986 | Reissmann | 198/461 |
| 5,004,094 | 4/1991 | Brandt | 198/460 |

FOREIGN PATENT DOCUMENTS

| | | | |
|---|---|---|---|
| 2242576 | 12/1982 | Fed. Rep. of Germany . | |
| 2428617 | 7/1983 | Fed. Rep. of Germany . | |
| 8604025 | 7/1986 | PCT Int'l Appl. | 412/2 |

*Primary Examiner*—Mark Rosenbaum
*Assistant Examiner*—S. Thomas Hughes
*Attorney, Agent, or Firm*—Darby & Darby

[57] ABSTRACT

Books or brochures are produced by transporting a series of elongated piles of superimposed paper sheets longitudinally through at least one stitching station where the sheets of each pile are mechanically connected to each other, thereupon sideways through a folding station where the piles are folded midway between their long sides to constitute folded piles each having a spine and two exposed outermost sheets, and thereupon longitudinally and sideways through a laminating station wherein the folded piles are provided with rigid or semirigid covers which are glued to the outer sides of their outermost sheets. The folded piles are then advanced lengthwise through a backstripping station, are compressed subsequent to stacking, singularized, trimmed, stacked and thereupon subdivided into stacks of superimposed books or brochures.

32 Claims, 5 Drawing Sheets

Fig.1a
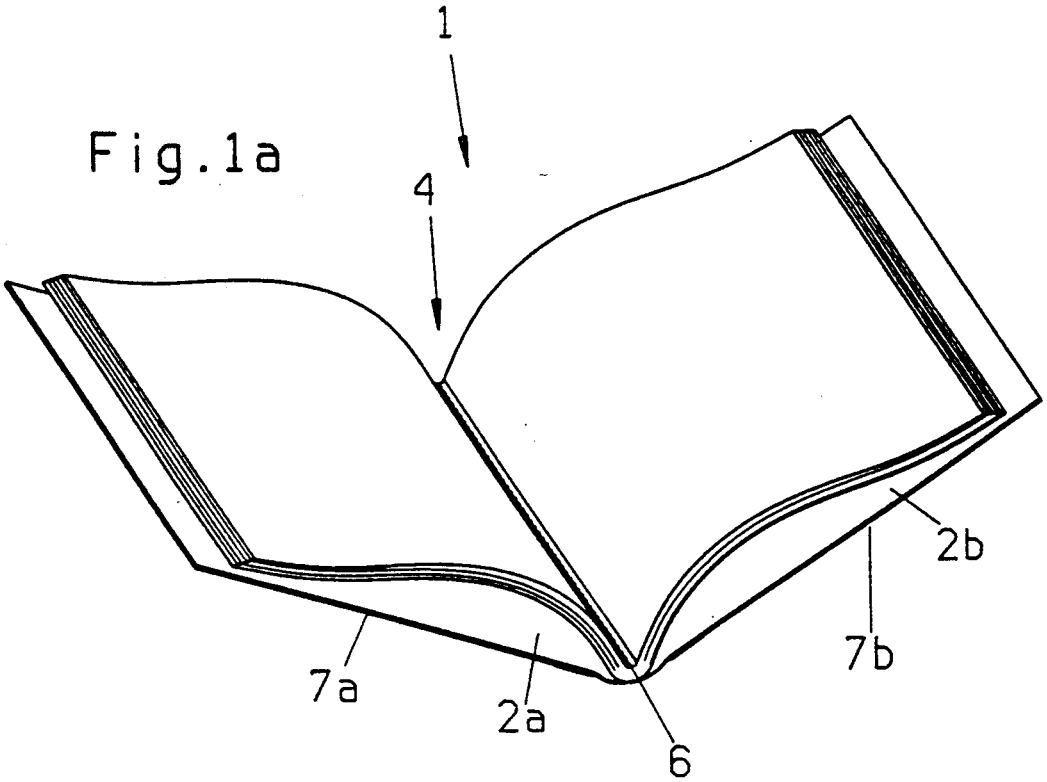
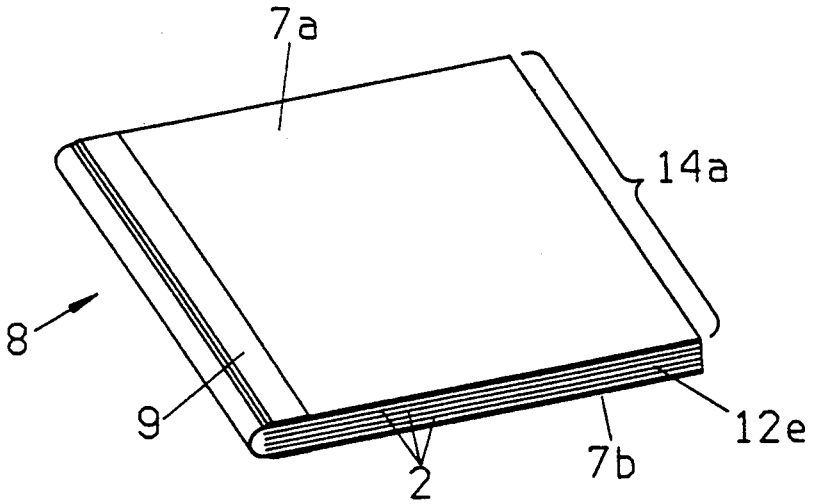
Fig.1b

METHOD OF AND APPARATUS FOR MAKING BOOKS

BACKGROUND OF THE INVENTION

The invention relates to improvements in methods of and in apparatus for making books, brochures and analogous articles (hereinafter called books for short). More particularly, the invention relates to improvements in methods of and in apparatus for making books from multiple-size folded piles of overlapping sheets which can be subdivided into discrete books.

It is already known to connect the sheets of successive piles of overlapping sheets to each other, to fold the piles so that each folded pile has two outermost sheets, to attach a cover to each outermost sheet, and to thereupon subdivide each pile into two or more discrete books.

OBJECTS OF THE INVENTION

An object of the invention is to provide an automatic method of making high-quality books.

Another object of the invention is to provide a method which renders it possible to turn out large numbers of books per unit of time.

A further object of the invention is to provide a novel and improved method of securing covers, for example, rigid or semirigid covers, to outermost sheets of piles of interconnected sheets in the course of a book producing operation.

An additional object of the invention is to provide a method which renders it possible to enhance the appearance of books with little loss in time.

Still another object of the invention is to provide a novel and improved method of making backstripped books.

A further object of the invention is to provide a novel and improved method of making large numbers of books in a small area.

Another object of the invention is to provide a novel and improved method of transporting components of books in a book producing plant.

An additional object of the invention is to provide a novel and improved method of simultaneously converting large numbers of multiple-size piles of overlapping sheets into discrete books.

Still another object of the invention is to provide a novel and improved apparatus for the practice of the above outlined method.

A further object of the invention is to provide the apparatus with novel and improved means for transporting the component parts of books, such as piles of loosely overlapping and interconnected sheets, back strips and covers.

Another object of the invention is to provide the above outlined apparatus with novel and improved means for securing covers, such as rigid or semirigid covers, to outermost sheets of folded multiple-size piles of sheets.

An additional object of the invention is to provide the above outlined apparatus with novel and improved means for enhancing the appearance of books.

Still another object of the invention is to provide the apparatus with novel and improved means for manipulating folded piles of interconnected sheets.

A further object of the invention is to provide the apparatus with novel and improved means for grouping and/or otherwise assembling folded piles of interconnected sheets of paper or the like.

SUMMARY OF THE INVENTION

One feature of the present invention resides in the provision of a method of making books from back strips, covers and piles each composed of a plurality of overlapping sheets having a size several times that of a book page. The improved method comprises the steps of transporting a series of successive piles along a predetermined path, mechanically connecting the sheets of each of the successive piles to each other in at least one first portion of the predetermined path, thereafter folding successive piles of the series in at least one second portion of the predetermined path to convert each pile into a folded pile having a spine and two outermost sheets, adhesively securing the outermost sheets of successive folded piles to covers in at least one third portion of the predetermined path, adhesively affixing back strips to the spines of successive folded piles in at least one fourth portion of the predetermined path, and thereafter subdividing each folded pile into a plurality of books in at least one fifth portion of the predetermined path.

The piles and their sheets are preferably elongated so that each pile has a pair of parallel long sides. The transporting step of the method of making books from such piles includes advancing successive piles at the at least one first portion of the predetermined path in the direction of the long sides of the piles, and the connecting step of such method can include establishing mechanical connections between the sheets of each of the series of piles in the aforementioned direction, i.e., in parallelism with the long sides of the respective piles.

The transporting step can further include advancing successive piles of the series of piles at the at least one second portion of the predetermined path in a direction substantially at right angles to the long sides of the piles, and the folding step of such method can comprise folding successive piles between their long sides and substantially at right angles to the direction of advancement of piles in the at least one second portion of the predetermined path.

The method can further comprise the steps of transporting a second series of successive piles having pairs of parallel long sides along a second path toward the at least one second portion of the predetermined path, mechanically connecting the sheets of each successive pile of the second series to each other in the second path, and transferring successive piles of the second series into the predetermined path so that the piles of the second series alternate with piles which are transferred from the at least one first into the at least one second portion of the predetermined path. The piles in the second path are preferably parallel to piles which advance at the at least one first portion of the predetermined path.

The connecting step can comprise sewing the sheets of each of the single series or two series of piles to each other at the at least one first portion of the predetermined path and/or in the second path.

The folding step can include folding successive piles of the series to form the respective spines, and the method can further comprise the step of flattening the spines of successive folded piles of the single series or of each series in at least one further portion of the predetermined path between the at least one second portion and the at least one third portion of the predetermined path.

The method can also comprise the steps of accumulating the folded piles and the adhesively secured covers into a series of successive groups subsequent to the securing step and prior to the subdividing step, and jointly pressing successive groups of the series of groups in at least one additional portion of the predetermined path between the at least one third portion and the at least one fifth portion. The transporting step of such method can comprise advancing successive piles substantially at right angles to their long sides during transport of the piles at the second and additional portions of the predetermined path. The folding step of such method can comprise folding successive piles of the series to form the respective spines, and the method can further comprise the step of flattening the spines of successive folded piles of the series in at least one further portion of the predetermined path between the second and third portions. The transporting step of such method can include advancing successive folded piles of the series substantially at right angles to the piles during transport of the piles at the at least one further portion of the predetermined path.

The connecting step can include applying rows of stitches to successive piles of the series, and the folding step of such method can comprise folding successive piles along the respective rows of stitches to form the spines of the thus obtained folded piles. Such method can further comprise the step of applying adhesive to the rows of stitches at the spines of successive folded piles in another portion of the predetermined path between the at least one second portion and the at least one fourth portion of the predetermined path. The transporting step of this method can comprise advancing successive piles substantially at right angles to their long sides during transport at the at least one second and at the at least one fourth portion of the predetermined path.

The method can also comprise the step of trimming successive piles of the series between the fourth and fifth portions of the predetermined path. Such method can also comprise the steps of superimposing groups of successive trimmed piles prior to the subdividing step and positioning groups of superimposed trimmed piles next to each other to form blocks of groups prior to the subdividing step. The transporting step of such method can comprise advancing successive piles of the series substantially at right angles to their long sides in the course of the trimming, stacking and block forming steps. The subdividing step can comprise simultaneously severing the folded piles of successive blocks so that each block yields elongated files of stacks of books. Still further, such method can comprise the step of singularizing the files of superimposed stacks of books, and the transporting step of this method preferably further includes advancing the files of stacked books longitudinally in the course of the singularizing step. The step of simultaneously severing normally involves the making of elongated files of superimposed stacks of books which have pronounced corners, and the method can further comprise the step of rounding or otherwise influencing the shape of the corners of the stacks of books subsequent to the singularizing step.

The securing step can comprise feeding a first adhesive-coated cover to one outermost sheet of a folded pile at the at least one third portion of the predetermined path, thereupon inverting the folded pile at the at least one third portion of the path, and thereafter feeding a second adhesive-coated cover to the other outermost sheets of the inverted folded pile at the at least one third portion of the predetermined path. Each feeding step can include conveying the respective cover past an adhesive applying station and coating one side of the conveyed cover with adhesive at the adhesive applying station.

Another feature of the present invention resides in the provision of an apparatus for making books from back strips, covers and piles each of which is composed of a plurality of overlapping sheets having a size several times that of a book page. The improved apparatus comprises means for transporting successive piles of a series of piles along at least one elongated path, means for connecting the sheets of each of the series of piles to each other in at least one first portion of the path, means for folding the connected sheets of successive piles of the series in at least one second portion of the path to convert each pile into a folded pile having a spine and two outermost sheets, means for adhesively securing the outermost sheets of successive folded piles to covers in at least one third portion of the path, means for adhesively affixing back strips to the spines of successive folded piles in at least one fourth portion of the path, and means for subdividing successive backstripped folded piles into a plurality of books in at least one fifth portion of the path.

The books are preferably made from elongated piles having pairs of parallel long sides, and the folding means of the improved apparatus preferably comprises means for folding the sheets of successive piles between and in substantial parallelism with the long sides of successive piles.

The securing means preferably includes at least one source of rigid or semirigid covers.

The connecting means can comprise means for sewing rows of threads through successive piles of the series substantially midway between the long sides of successive piles, and the transporting means of such apparatus can comprise means for advancing successive piles in the direction of their long sides during transport at the at least one first portion of the path.

The folding means of the improved apparatus can include means for folding successive piles of the series substantially midway between the long sides of the respective piles, and the transporting means can comprise means for advancing successive piles of the series substantially at right angles to their long sides during transport at the at least one second portion of the path.

As mentioned above, the connecting means can include means for sewing threads through successive piles, namely at the spines which develop as a result of subsequent folding of the piles, and such apparatus can further comprise means for applying adhesive to the spines of the folded piles to bond the stitches to the respective sheets in at least one other portion of the at least one path ahead of the at least one fourth portion.

The apparatus can further comprise means for trimming successive folded piles and the covers which are secured to the outermost sheets of the folded piles. Such trimming can take place in at least one portion of the at least one path between the third and fifth portions of the path.

The apparatus can also comprise means for superimposing groups of successive folded piles and means for positioning the thus obtained groups of folded piles next to each other to form blocks of groups ahead of the at least one fifth portion of the at least one path. The subdividing means of such apparatus can comprise means for simultaneously severing the folded piles of successive blocks so that each block yields elongated files of stacked books.

The aforementioned securing means can include at least one source of (preferably rigid or semirigid) covers, means for feeding a first adhesive-coated cover from the at least one source against one outermost sheet of the folded pile in the at least one third portion of the at least one path, means for thereafter inverting the folded pile at the at least one third portion of the at least one path, and means for thereupon feeding a second adhesive-coated cover from the at least one source against the other outermost sheet of the folded pile at the at least one third portion of the at least one path. Such apparatus can further comprise means for applying an adhesive to one side of each cover which is being fed from the at least one source to an outermost sheet of a folded pile at the at least one third portion of the at least one path.

The improved apparatus can also comprise means for compressing successive folded piles and the covers which are secured to the folded piles between the at least one third portion and the at least one fifth portion of the at least one path.

Still further, the apparatus can comprise means for gathering folded piles and the covers which adhere to the outermost sheets of folded piles into groups of superimposed folded piles, and means for compressing the groups of superimposed folded piles and covers between the at least one third portion and the at least one fifth portion of the at least one path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 1*a* is a perspective view of an open book which is produced in accordance with the method and in the apparatus of the present invention;

FIG. 1*b* is a perspective view of the book in closed position;

DESCRIPTION OF PREFERRED EMBODIMENTS

Figure 2A:
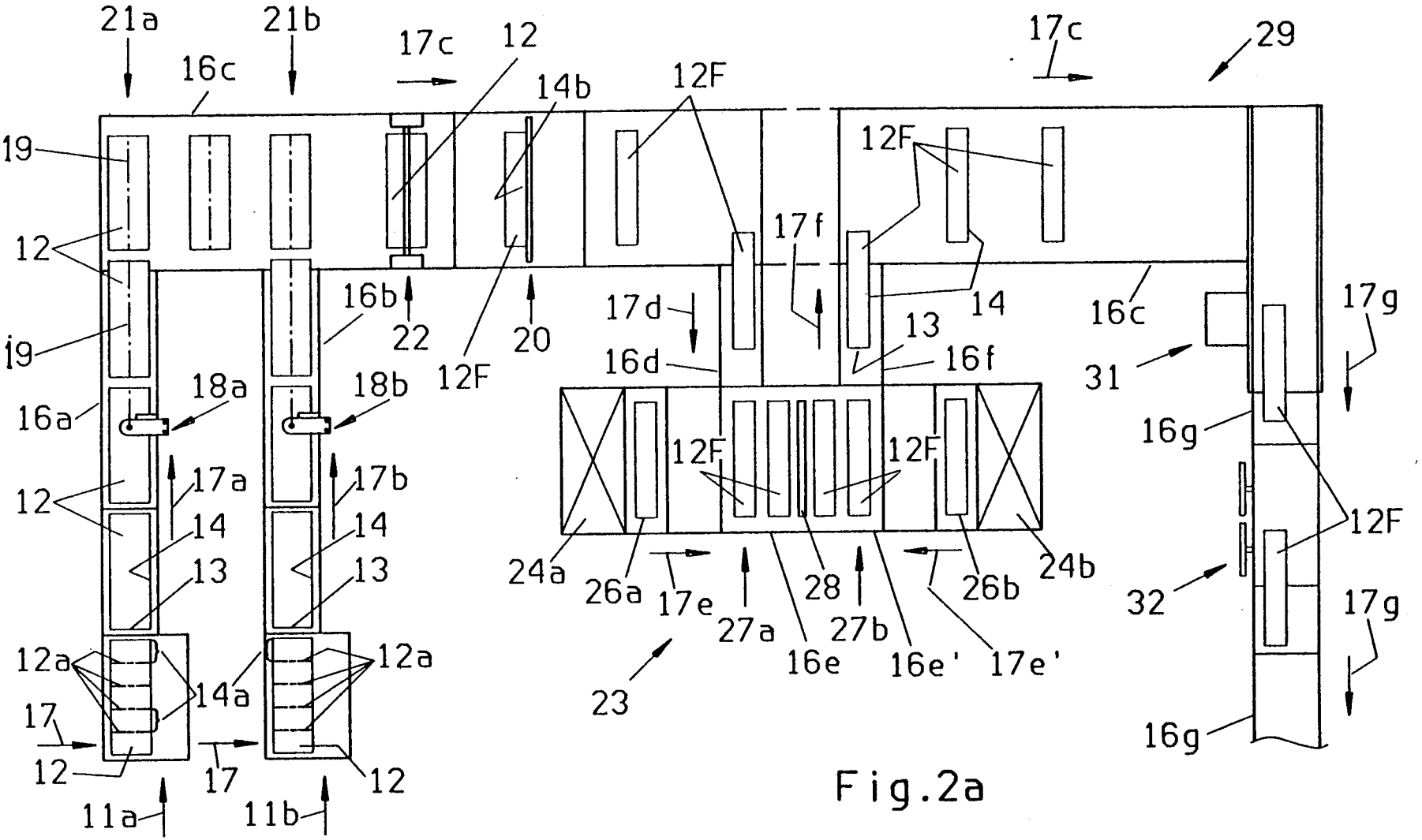
FIG. 2*a* is a schematic plan view of a first portion of an apparatus which embodies one form of the invention.

FIGS. 1*a* and 1*b* show a book 1 which can be made in accordance with the method and in the apparatus of the present invention. The book 1 comprises pages or sheets 2 including a foremost sheet or page 2*a* and a rearmost sheet or page 2*b*. The page 2*a* is bonded to the adjacent side of a preferably rigid or semirigid front cover 7*a*, and the page 2*b* is bonded to the adjacent side of a preferably rigid or semirigid rear cover 7*b*. The back or spine 8 of the folded pile 12*e* or stack which forms the pages or sheets is overlapped by and is bonded to a so-called back strip 9 which also overlies the adjacent rearmost portions of the outer sides of covers 7*a* and 7*b*. The reference character 6 denotes a mechanical connector here shown as a row of stitches which connect the neighboring sheets 2 (each such sheet is composed of a front page and a rear page (i.e., a page forming part of the front half and a page forming part of the rear half of the book 1) to each other along the median or fold line 4. Each front page forms with the corresponding rear page a rectangular sheet or panel which is obtained by severing a larger (longer) sheet forming part of a pile 12 to be described in detail with reference to FIGS. 2*a*, 2*b*, 3 and 4. The pages can be made of paper and the covers 7*a*, 7*b* can be made of cardboard, stiff paper, plastic or any other suitable material. The stitches 6 can be replaced with other connecting means, preferably mechanical connecting means, such as one or more staples. The back strip 9 can be made of paper, plastic, textile or any other suitable flexible material which can be bonded to the spine 8 and/or to the covers 7*a*, 7*b*. Though FIGS. 1*a* and 1*b* show a book 1 with substantially square pages (each having a height 14*a*), it is equally possible to make the book with pages which are elongated in the direction of or transversely to the fold line 4 and spine 8.

Figure 2B:
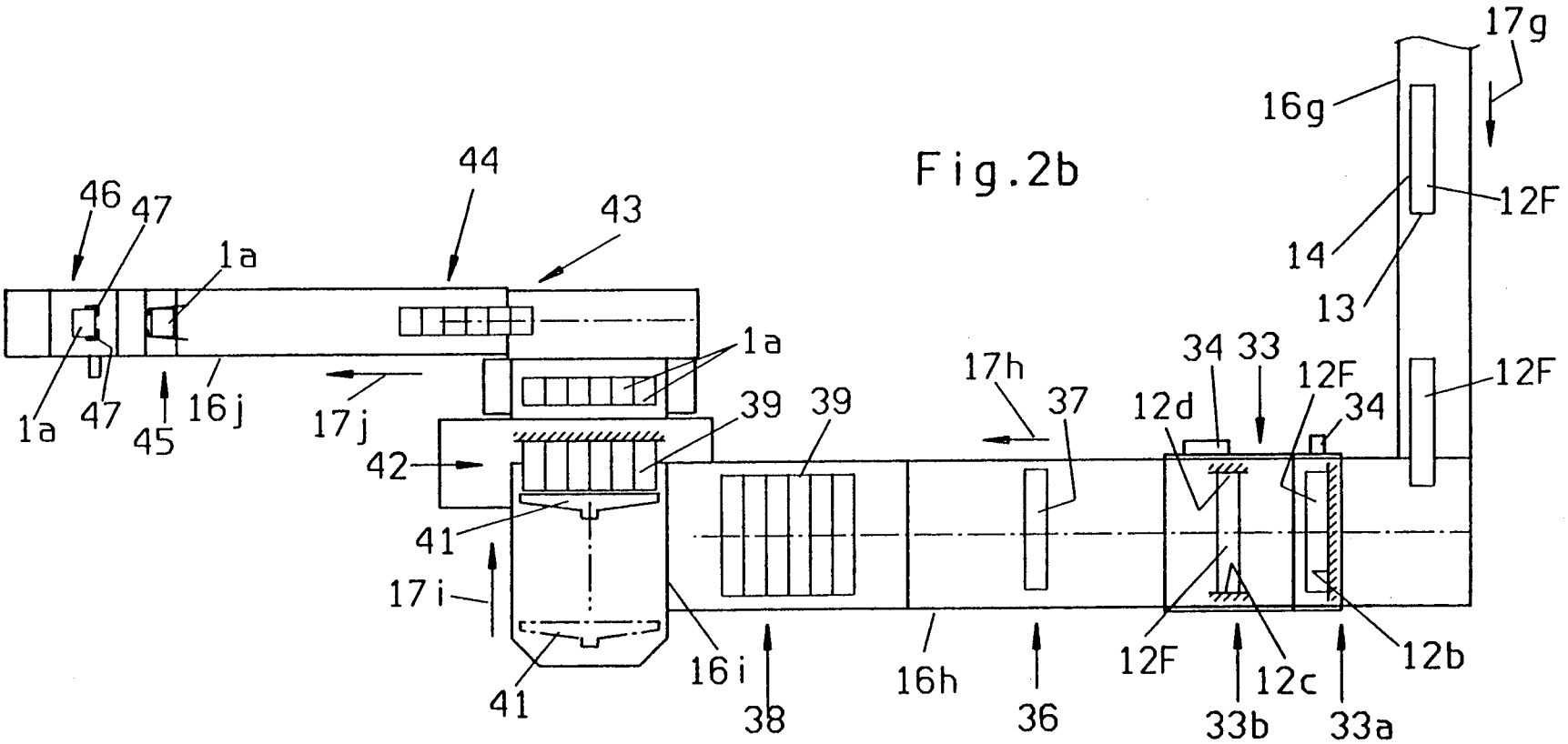
FIG. 2*b* is a schematic plan view of the remaining portion of the apparatus.

FIGS. 2*a* and 2*b* show those components of an improved book manufacturing apparatus which are considered necessary for full understanding of the invention. Such components are illustrated in a plan view and are shown in a distribution such that the apparatus assumes the shape of a substantially square or rectangular production line. The apparatus includes a composite transporting unit having a series of conveyors 16*a* to 16*e*, 16*e'* and 16*f* to 16*j* which together define two elongated paths including a first path (arrows 17*a*, 17*c* to 17*e*, 17*e'* and 17*f* to 17*j*) and a second path (arrow 17*b*) which is shown as being parallel to a first portion of the first path and merges into the first path at 21*b*.

The inlet (at 11*a*) of the first path receives a series of successive unfolded multiple-size piles or stacks 12 (hereinafter called piles for short) of overlapping sheets or panels each having a size approximately five times that of the combined size of a pair of pages 2*a*, 2*b*. The number of sheets in a pile 12 is half the number of pages in a book 1, and the length of each pile 12 is five times 14*a*, namely five times the height of a page 2*a* or 2*b* as measured in the direction of the fold line 4 of a book 1.

The layers 12 can be formed at the inlets 11*a*, 11*b* of the two paths, or they can be delivered to these inlets by conveyor means from one or more partially or fully automated sheet piling or stacking machines. One presently preferred mode of assembling piles 12 is to draw a web off a bobbin, provide (if necessary) at least one side of the web with printed matter and/or other information, employ a cross cutter in order to subdivide the web into a series of sheets, and to thereupon stack requisite numbers of sheets on top of each other to form a succession of piles 12. The thus (or otherwise) formed piles 12 are delivered to the inlets 11*a* and 11*b* in directions which are indicated by arrows 17, e.g., by one or more automatically operated conveyors (not shown) to ensure delivery of piles at required intervals.

It is within the purview of the invention to assemble the sheets into discrete piles by resorting to semiautomatic stacking means and to transfer the piles 12 into the inlets 11*a*, 11*b* by hand.

The width 13 (i.e., the length of a short side) of each pile 12 matches the width of an open book 1, i.e., it equals the combined width of the pages 2*a* and 2*b*. The length of the long sides 14 of a pile 12 is five times the length of a page 2*a* or 2*b* (as measured in the direction of the fold line 4 of a book) because each of the illustrated piles is dimensioned to be assembled with two covers of equal length and to be thereupon severed in parallelism with its short sides 13 to yield five books 1. In other words, the length of a long side 14 equals five times the height 14*a* of a book 1. The locations where the layers 12 are to be severed in order to yield sets of five books 1 each are indicated in FIG. 2*a* by broken lines 12*a*. As used herein, the term "multiple" is intended to denote the number of books which can be produced from a pile 12 in combination with a back strip 9 and two covers.

The first two conveyors 16*a*, 16*b* respectively transport successive piles 12 of the respective series of piles in directions which are indicated by the arrows 17*a* and 17*b*, respectively. Thus, the freshly admitted piles 12 are transported in the directions of their long sides 14. Successive piles 12 which advance in the direction of arrow 17*a* move toward, through and beyond a first portion of their path, and such first portion accommodates a machine 18*a* which mechanically connects the sheets of successive piles to each other. The illustrated machine 18*a* is a sewing machine which is designed to make stitches 6 of the type shown in FIG. 1*a*. Such stitches are located midway between the long sides 14 of the respective piles 12 as indicated in FIG. 2*a* by a dot-dash line 19. For example, the machine 18*a* an be a so-called in-line twin chain stitch sewing machine known as Series 477 and distributed by Dürkopp & Adler, Bielefeld, Federal Republic Germany. The machine 18*a* can be designed and set up in such a way that it provides stitches only along a certain portion of the fold line of each of the five coherent sections of a pile 12. However, it is equally possible to employ a machine 18*a* which makes a continuous row of stitches 6 all the way between the two short sides 13 of each of a series of successive piles 12. The fold lines 4 are formed subsequent to the making of stitches 6, and such fold lines are made by folding each pile 12 exactly along the center line 19, i.e., at the locations of the stitches 6. Such folding takes place in a second portion of the path for the piles 12 downstream of the (first) portion which accommodates the sewing machine 18*a*.

A second sewing machine 18*b*, which is preferably identical with the machine 18*a*, is adjacent a portion of the second path for piles 12 which are delivered to the inlet 11*b* and are transported by the conveyor 16*b* in the direction of arrow 17*b*, i.e., in parallelism with the piles 12 which are admitted at 11*a*.

The piles 12 which advance beyond the respective sewing machines 18*a*, 18*b* reach two deflecting or diverting stations 21*a*, 21*b* and are taken over by the third conveyor 16*c* which also forms part of the transporting unit and is constructed and assembled to advance the piles 12 sideways (arrow 17*c*), i.e., at right angles to their long sides 14 and in at least substantial parallelism with the short sides 13. The conveyor 16*c* advances successive piles 12 toward, through and beyond a folding machine 22. The transporting unit of FIGS. 2*a* and 2*b* is designed in such a way that the series of piles 12 advancing toward the folding machine 22 consists of piles 12 supplied by the conveyors 16*a* and 16*b* whereby the piles supplied by 16*a* alternate with piles which are supplied by 16*b*.

The machine 22 converts each pile 12 into a folded pile 12F by folding it along the center line 19 so that each folded pile contains two sets of sheets or pages and each of these sets includes an outermost sheet (each of the pages 2*a*, 2*b* in the book 1 of FIGS. 1*a* and 1*b* forms part of one of the two outermost sheets of the respective folded pile 12F). Such folding further results in the formation of a spine or back 8 which extends all the way between the short sides 13 of the respective pile. The exact construction of the folding machine 22 forms no part of the present invention. A machine which can be utilized in the second portion of the path defined by the conveyors of the transporting unit 16*a*–16*j* is disclosed, for example, in German Pat. No. 22 42 576 to which reference may be had, if necessary.

Successive folded piles 12F advance from the machine 22 into the range of a rolling device 20 which is provided with one or more rollers (not specifically shown) serving to flatten the piles 12F in the region of their fold lines 14*b*. Such treatment enhances the appearance and contributes to compactness of the books 1. The device 22 can comprise a suitable roll which is biased against the upper sides of successive folded piles 12F, at least when such roll is in register with the fold lines 14*b* of the neighboring piles. It is also possible to employ two or more spring-biased or pneumatically or hydraulically biased rolls which are mounted for movement in and counter to the direction of arrow 17*c* to repeatedly roll over the fold lines 14*b* of successive piles 12F.

The conveyor 16*c* delivers successive folded piles 12F to the conveyor 16*d* which advances such piles in the direction (arrow 17*d*) of their long sides 14 into the range of a laminating unit 23 including means for adhesively securing the two outermost sheets of each folded pile 12F to a pair of discrete covers 7*a*, 7*b* each having a length corresponding to that of a long side 14 and a width equal to or perhaps slightly less than half the width 13 of a pile 12. The laminating unit 23 comprises two sources (e.g., magazines) of stacked covers, namely a magazine 24*a* for stacked covers 7*a* and a magazine 24*b* for stacked covers 7*b*. A first coating device or paster 26*a* is adjacent the path of movement of successive covers 7*a* from the magazine 24*a* toward an inverting or turn-around device 28, and a second coating device or paster 26*b* is adjacent the path of movement of successive covers 7*b* from the magazine 24*b* to the inverting device 28. The manner in which the covers 7*a* are transported by the conveyor 16*e* in the direction of arrow 17*e* and the covers 7*b* are transported by the conveyor 16*e*' in the direction of arrow 17*e*' will be described in detail with reference to FIG. 3. The purpose of the paster 26*a* is to coat one side of each cover 7*a* with a film of suitable adhesive so that such cover can be caused to adhere to the outer side of the upper outermost sheet of the folded pile 12F at a station 27*a* adjacent the inverting device 28. The latter then turns the folded pile 12F and the cover 7*a* through 180° to thus position the other outermost sheet of the pile 12F on top at a station 27*b*. The latter then receives a cover 7*a*, one side of which has been provided with a film of adhesive in the paster 26*b*, and such cover 7*b* is caused to adhere to the upper side of the other outermost sheet before the resulting assembly of a folded pile 12F and covers 7a, 7b is transported by the conveyor 16f in the direction (arrow 17f) of the long sides 14 of the folded pile 12F back onto the conveyor 16c. Thus, the direction of transport of a pile 12F with two covers 7a, 7b is changed from that indicated by arrow 17f to that indicated by the arrow 17c, and the piles 12F then advance to a compressing station 29 the details of which are shown in FIG. 4.

Figure 4:
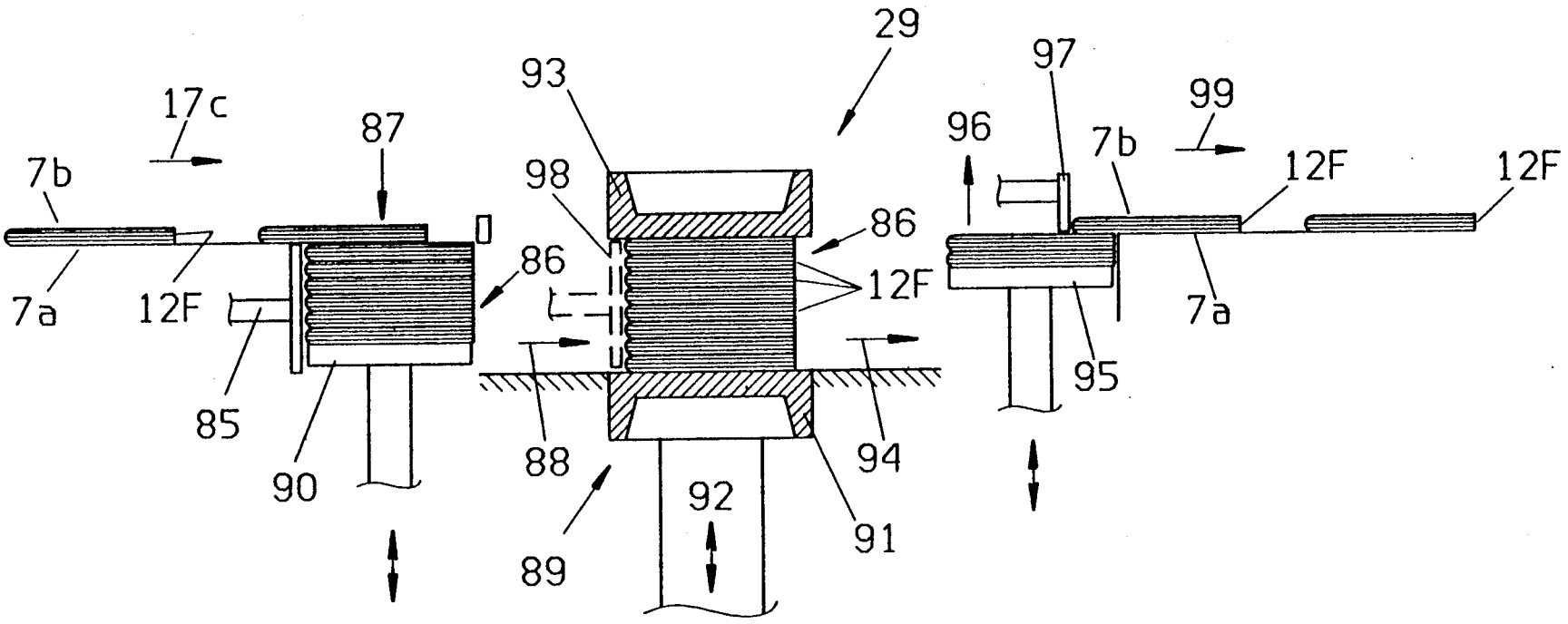
FIG. 4 is an enlarged partly elevational and partly sectional view of a unit which can be utilized in the apparatus of FIGS. 2*a* and 2*b* to accumulate folded piles into groups ahead, and to singularize the grouped piles downstream, of a compressing station.

Successive piles 12F which are in the process of advancing (arrow 17c) to the compressing station 29 are gathered into groups 86 of superimposed piles and such groups are then subjected to the action of a compressing means, such as the press 89 of FIG. 4, to complete the bonding of covers 7a, 7b to the outer sides of the respective outermost sheets of the piles 12F. An advantage of the step of gathering predetermined numbers of successively advanced folded piles 12F (with covers 7a, 7b attached thereto) into groups 86 is that the period of dwell in the press 89 can be prolonged without causing the development of a bottleneck at the compressing station 29.

The folded piles 12F of successive groups 86 are singularized downstream of the press 89 (see the right-hand portion of FIG. 4), and the singularized laminated piles 12F are taken over by the conveyor 16g which advances them (arrows 17g) in the direction of their long sides 14 as shown in the right-hand portions of FIGS. 2a and 2b. Successive laminated piles 12F advance through an adhesive applying unit 31, e.g., a unit of the type disclosed in U.S. Pat. No. 4,310,576 to which reference may be had, if necessary. The purpose of the unit 31 is to apply adhesive to those portions of the stitches 6 which are accessible at the spines 8 of successive piles 12F; such adhesive bonds the stitches to the adjacent sheets and thus reinforces the mechanical connections between the sheets of successive piles 12F.

The adhesive applying unit 31 is followed by a back-stripping unit 32 which can be of the type disclosed, for example, in German Pat. No. 24 28 617 or in U.S. Pat. No. 4,151,037. The unit 32 is designed to apply back strips 9 to the spines 8 of successive folded and laminated piles 12F while the piles advance in the direction of their long sides 14 (arrows 17g). The width of each back strip 9 can be such that it overlies the respective spine 8 as well as the outer sides of the adjacent portions of the respective covers 7a and 7b.

The sewing machines 18a, 18b are located at first portions of the path of the respective piles 12, the folding unit 22 is located in the second portion, the unit 23 is located in the third portion, and the unit 32 is located in the fourth portion of the path of (folded) piles 12F.

The laminated and backstripped piles 12F are then taken over by the conveyor 16h which advances them (arrow 17h) at right angles to their long sides 14 on to a trimming unit 33 of any known design. The illustrated trimming unit 33 includes a first portion or section 33a which serves to trim the long edges 12b of successive backstripped piles 12F, and a second portion or section 33b which serves to trim the two shorter edges 12b, 12c of successive backstripped piles 12F. The waste, i.e., the material which was removed from the sheets and covers of successive backstripped piles 12F, is collected by a device 34, e.g., a suitable vacuum cleaner or the like.

The trimmed backstripped piles 12F are advanced to a station accommodating a superimposing unit 36 which converts preselected numbers of successively advanced piles 12F into groups 37 of superimposed piles. The groups 37 are advanced into the range of a positioning unit 38 which assembles preselected numbers of successively delivered groups 37 into blocks 39 of closely adjacent groups before the thus obtained blocks 39 reach a fifth portion of the path which accommodates a subdividing unit 42.

The subdividing unit 42 comprises a pusher 41 which advances the adjacent block 39 stepwise in the direction of arrow 17i and forms part of the conveyor 16i. The pusher 41 is reciprocable in the directions of long sides 14 of backstripped piles 12F which form the block 39 on the conveyor 16i, and this pusher cooperates with a severing device forming part of the subdividing unit 42 to convert the block 39 into a number of files 43 of stacks 1a of superimposed books 1. The severing device of the subdividing unit 42 can be constructed and can operate in a manner as disclosed, for example, in published German patent application serial No. 36 03 484. Successive files 43 are taken over by the conveyor 16j which advances them in the direction of arrow 17j (i.e., at right angles to the long sides 14 of piles 12F in the preceding portions of their path). The files 43 are broken up (i.e., the stacks 1a are singularized) at a singularizing station 44, and the singularized stacks 1a are advanced to an aligning station 45 and thence to a rounding or round trimming station 46 which is provided with means for trimming the normally pronounced corners 47 of the books in the stacks 1a before the thus finished stacks 1a are transferred to storage or to another destination. The equipment at the singularizing station 44 can be identical with or analogous to that disclosed, for example, in U.S. Pat. Nos. 4,629,058 or 5,004,094.

The construction of various conveyors 16a to 16j forming part of the transporting unit for the piles 12 and 12F (without and thereafter with covers 7a, 7b and back strips 9) is preferably such that the commodities thereon are advanced in stepwise fashion. This can be achieved by resorting to intermittently driven belt, band or chain conveyors and/or to intermittently operated pushers or analogous entraining elements. It is also possible to resort to suction operated conveyors, e.g., for the delivery of back strips and/or covers 7a, 7b into the path for the folded piles 12F.

Figure 3:
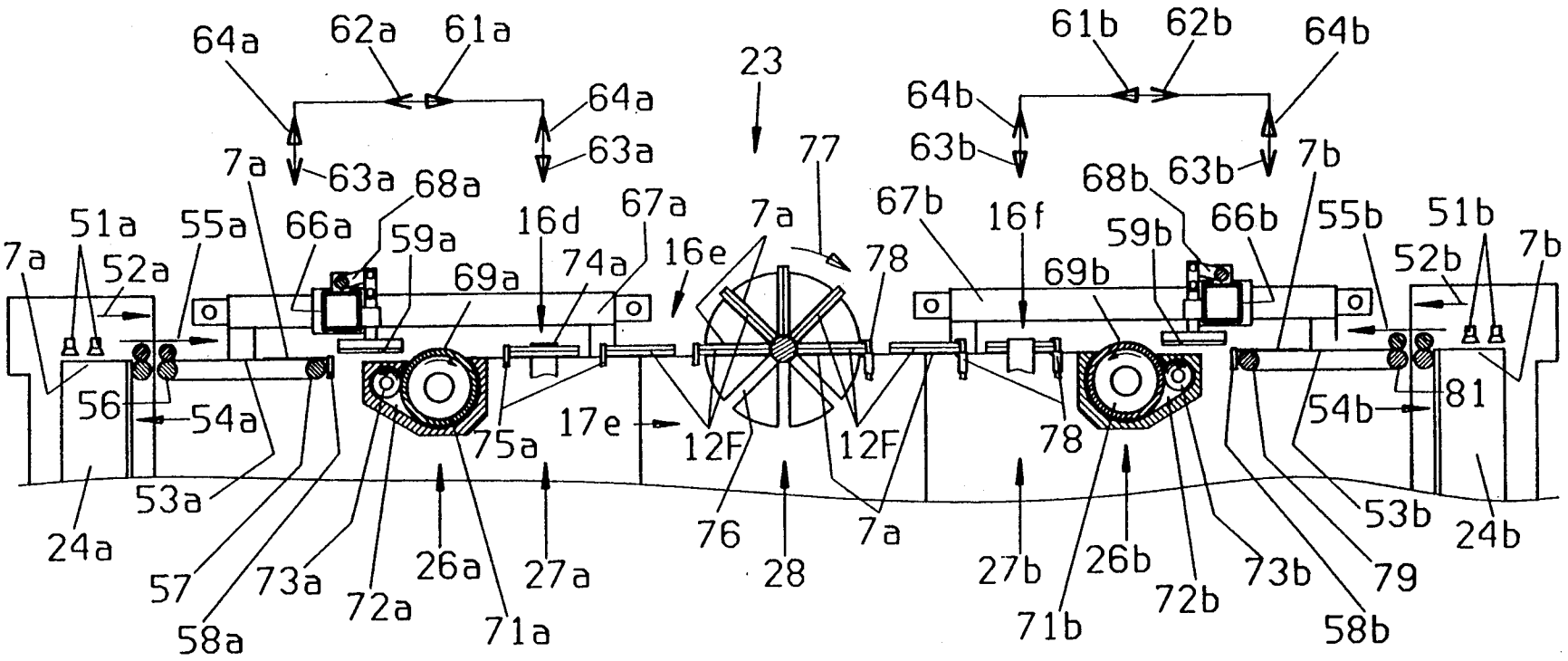
FIG. 3 is an enlarged partly elevational and partly sectional view of a cover feeding, coating and securing unit in the apparatus of FIGS. 2*a* and 2*b*.

Referring to FIG. 3, which shows the details of a presently preferred laminating unit 23, the conveyor 16e which delivers covers 7a from the magazine 24a to the inverting unit 28 comprises one or more endless belt conveyors 53a trained over pulleys 56 and 57 which are driven at selected intervals in a manner not forming part of the present invention. The conveyor 16e further comprises one or more suction heads 51a which are movable up and down as well as in the direction of arrow 52a to pick up successive uppermost covers 7a from the stack in the magazine 24a and to deposit such covers on the upper reach or reaches of the conveyor or conveyors 53a. The suction heads 51a are then returned in the direction of arrow 54a to pick up the next cover 7a. The upper reach or reaches of the conveyor or conveyors 53a advance successive covers 7a in the direction of arrow 55a so that the leaders of the covers come into abutment with a stop 58a. A conveyor 59a in the form of a vacuum operated plate forms part of the conveyor 16e and serves to deliver successive covers 7a from the stop 58a to the paster 26a. The conveyor 59a is movable up and down (as indicated by arrows 63a, 64a) as well as horizontally back and forth (as indicated by the arrows 61a, 62a) by a carrier in the form of a crosshead 66a which is reciprocable along a stationary guide rail 67a. The crosshead 66a imparts the necessary movements in the directions indicated by arrows 61a, 62a and levers 68a on the crosshead 67a can be actuated to impart the movements which are indicated by arrows 63a, 64a. The exact manner in which the plate-like conveyor 59a can be operated to transfer successive covers 7a from the stop 58a to and along the paster 26a is or can be similar to that disclosed, for example, in U.S. Pat. No. 4,334,608.

The paster 26a comprises a driven roller 69a which dips into a supply of paste in a vessel or tank 72a. The surplus of withdrawn adhesive paste is removed from the peripheral surface 71a by a roller-shaped squeegee 73a so that the peripheral surface 71a of the roller 69a carries a thin film of adhesive which is applied to the underside of the cover 7a at the underside of the plate-like conveyor 59a. The conveyor 59a is then moved in the direction of arrow 61a. The thus coated cover 7a is deposited by the conveyor 59a on top of the folded pile 12F which is being delivered by the conveyor 16d in the direction of arrow 17d, i.e., at right angles to the plane of FIG. 3. A pusher 74a of the conveyor 16d serves to advance the folded pile 12F to an optimum position for attachment of the underside of the freshly coated cover 7a to the upper side of the adjacent outermost (uppermost) sheet (2a) of the pile 12F at the station 27a, namely between the paster 26a and the inverting unit 28.

One of a series of pushers 75a of the conveyor 16e (or a tongs, not shown) serves to transfer the pile 12F and the cover 7a into the adjacent pocket or slot 76 of the indexible turret-shaped inverting unit 28 which is intermittently rotated in the direction of arrow 77. Successive folded piles 12F (and their covers 7a) are removed from the respective pockets 76 after they complete an angular movement through 180° (arrow 77). The removing means includes tongs 78 serving to advance the inverted piles 12F to the laminating or bonding station 27b in that portion of the path which is defined by the conveyor 16f. The tongs 78 are designed to pull the respective piles 12F and their covers 7a to the station 27b. The manner in which the covers 7b are transported from the magazine 24b toward and along the paster 26b to be thereupon attached to the upper sides of the uppermost sheets of piles 12F at the station 27b is the same as described above in connection with the coating and application of covers 7a. All parts shown in the right-hand portion of FIG. 3 are mirror images of the corresponding parts in the left-hand portion of FIG. 3 and nearly all of them are denoted by similar reference characters (with the letters a replaced by letters b). The direction in which the covers 7b are advanced from the magazine 24b to the turret of the inverting unit 28 is indicated in FIG. 2a by the arrow 17e'. The conveyor 16f is set in motion when the application of a cover 7b at the station 27b is completed, and the thus processed folded pile 12F (with covers 7a, 7b) is then advanced in the direction of arrow 17f back onto the conveyor 16c for transport to the compressing unit 29.

The reference numerals 79 and 81 denote in FIG. 3 the pulleys for the belt conveyor(s) 53b.

FIG. 4 illustrates the details of the compressing unit at the station 29 (next to the conveyor 16c of FIG. 2a). The conveyor 16c delivers folded piles 2F (each of which carries two covers 7a, 7b) in the direction of arrow 17c onto a platform 90 which is lowered stepwise in the direction of arrow 87 to accumulate a group 86 of superimposed piles 12F. A pusher 85 cooperates with the platform 90 to transfer a group 86 containing a predetermined number of piles 12F in the direction of arrow 88, namely into the space between a stationary upper jaw 93 and a mobile lower jaw 91 of the press 89. The lower jaw 91 is movable up and down in directions which are indicated by a double-headed arrow 92. Alternatively, the press 89 can comprise a stationary lower jaw and an upper jaw which is movable in directions indicated by the arrow 92. An important function of the press 89 is to complete the bonding of covers 7a, 7b to the outer sides of the respective outermost sheets of each folded and laminated pile 12F between the jaws 91 and 93. Furthermore, the treatment in the press 89 enhances the appearance of the ultimate products (books 1).

A pusher 98 (indicated by broken lines) is then actuated to move in the direction of arrow 94 and to transfer the group 86 from the space between the jaws 91, 93 onto a platform 95 which forms part of a singularizing unit and is lifted stepwise in the direction of arrow 96 to move successive uppermost piles 12F of a group 86 into the range of a reciprocating singularizing pusher 97. The latter moves successive piles 12F in the direction of arrow 99, namely into the range of the conveyor 16g which changes the direction of successive singularized piles 12F and transports them to the adhesive applying unit 31.

An important advantage of the structure which is shown in FIG. 4 is that the period of treatment of piles 12F between the jaws 91, 93 of the press 89 can be prolonged without reducing the output of the improved apparatus. However, it is also within the purview of the invention to dispense with the step of gathering the piles 12F into a series of groups 86 ahead of the press 89, i.e., the piles 12F and their covers 7a, 7b can be laminated in the press 89 or in an analogous press one after the other. This renders it possible to dispense with the singularizing means including the platform 95 and the pusher 97.

An advantage of the improved method and apparatus is that they render it possible to turn out large numbers of high-quality books 1 per unit of time. An important reason for the ability of the apparatus to turn out large numbers of books per unit of time is that the apparatus can treat piles 12 and 12F each of which can be subdivided into a substantial number of individual books. It is to be understood that the sizes of the piles 12 can be increased (to yield more than five books) or reduced without departing from the spirit of the invention.

Another advantage of the improved method and apparatus is that the method can be practiced in a compact apparatus. The reason is that, wherever possible, the piles 12 and 12F are transported in directions at right angles to their long sides 14. This also holds true for treatment at stations (such as that accommodating the folding unit 22, the rolling unit 20 and the laminating unit 23) which, in conventional apparatus, are disposed adjacent path portions wherein the piles are advanced lengthwise rather than sideways.

The laminating unit 23, which is believed to embody features that are patentable per se, permits fully automatic and accurate application of covers 7a and 7b to the outer sides of the outermost sheets 2a, 2b of successive folded piles 12F in a small area and at a high frequency. This unit can be designed to provide the folded piles 12F with soft covers but preferably with rigid or semirigid covers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making books from back strips, covers and piles with each pile composed of a plurality of overlapping sheets having a size several times that of a book page, comprising the steps of transporting a series of successive piles along a predetermined path; mechanically connecting the sheets of each of said successive piles to each other in at least one first portion of said path; thereafter folding successive piles of the series in at least one second portion of the path to convert each pile into a folded pile having a spine and two outermost sheets; adhesively securing the outermost sheets of successive folded piles to covers in at least one third portion of said path; adhesively affixing back strips to the spines of successive folded piles in at least one fourth portion of the path; and thereafter subdividing each folded pile into a plurality of books in at least one fifth portion of said path.

2. The method of claim 1, each of the piles comprising elongated sheets having pairs of parallel long sides, wherein said transporting step includes advancing successive piles at the at least one first portion of said path in the direction of the long sides of the sheets, said connecting step including establishing mechanical connections between the sheets of each of the series of piles in said direction.

3. The method of claim 1, each of the piles comprising elongated sheets having pairs of parallel long sides, wherein said transporting step includes advancing successive piles at the at least one second portion of said path in a direction substantially at right angles to the long sides of the respective sheets and said folding step comprises folding successive piles between the long sides of the respective sheets and substantially at right angles to said direction.

4. The method of claim 1, each of the piles comprising elongated sheets having pairs of parallel long sides, wherein said transporting step comprises advancing successive piles at the at least one first portion of said path in the direction of the long sides of the respective sheets and thereafter advancing successive piles in a direction substantially at right angles to the long sides of the respective sheets, and further comprising the steps of transporting a second series of successive piles having sheets with pairs of parallel long sides along a second path toward said at least one second portion of said predetermined path, mechanically connecting the sheets of each of said successive piles of the second series to each other in said second path, and transferring successive piles of the second series into the predetermined path so that the piles of the second series alternate with piles which are transferred from the at least one first into the at least one second portion of the predetermined path, the piles in the second path being parallel to piles advancing at the at least one first portion o the predetermined path.

5. The method of claim 1, wherein the connecting step comprises sewing the sheets of each of the series of piles to each other at the at least one first portion of the path.

6. The method of claim 1, wherein the folding step includes folding successive piles of the series to form the respective spines, and further comprising the step of flattening the spines of successive folded piles of the series in at least one further portion of said path between the at least one second and the at least one third portion of the path.

7. The method of claim 1, further comprising the steps of accumulating the folded piles and the adhesively secured covers into a series of successive groups subsequent to said securing step and prior to said subdividing step, and jointly pressing successive groups of the series of groups in at least one additional portion of said path between said third and fifth portions.

8. The method of claim 7, each of the piles comprising elongated sheets having pairs of parallel long sides, wherein said transporting step comprises advancing successive piles substantially at right angles to the long sides of the respective sheets during transport at the second and additional portions of said path.

9. The method of claim 8, wherein the folding step includes folding successive piles of the series to form the respective spines and further comprising the step of flattening the spines of successive folded piles of the series in at least one further portion of said path between said second and third portions, said transporting step including advancing successive folded piles of the series substantially at right angles thereto during transport at the at least one further portion of said path.

10. The method of claim 1, wherein said connecting step includes applying rows of stitches to successive piles of the series and said folding step comprises folding successive piles along the respective rows of stitches to form the spines of the folded piles, and further comprising the step of applying adhesive to the rows of stitches at the spines of successive folded piles in another portion of said path between the second and fourth portions.

11. The method of claim 10, each of the piles comprising elongated sheets having pairs of parallel long sides, wherein said transporting step comprises advancing successive piles substantially at right angles to the long sides of the respective sheets at the other and fourth portions of the path.

12. The method of claim 1, further comprising the step of trimming successive piles of the series between the fourth and fifth portions of the path.

13. The method of claim 12, further comprising the step of superimposing groups of successive trimmed piles prior to said subdividing step.

14. The method of claim 13, further comprising the step of positioning groups of superimposed trimmed piles next to each other to form blocks of groups prior to said subdividing step.

15. The method of claim 14, each of the piles comprising elongated sheets having pairs of long sides, wherein said transporting step comprises advancing successive piles of the series substantially at right angles to the long sides of the respective sheets in the course of said trimming, stacking and block forming steps.

16. The method of claim 15, wherein said subdividing step comprises simultaneously severing the folded piles of successive blocks whereby each block yields elongated files of stacks of books.

17. The method of claim 16, further comprising the step of singularizing the files of superimposed stacks of books, said transporting step including advancing the files longitudinally in the course of said singularizing step.

18. The method of claim 17, wherein said step of simultaneously severing includes making elongated files of superimposed stacks of books having pronounced corners, and further comprising the step of rounding the corners of the stacks of books following said singularizing step.

19. The method of claim 1, wherein said securing step includes feeding a first adhesive-coated cover to one outermost sheet of a folded pile at the at least one third portion of the path, thereupon inverting the folded pile at the at least one third portion of the path, and thereafter feeding a second adhesive-coated cover to the other outermost sheet of the inverted folded pile at the at least one third portion of said path.

20. The method of claim 19, wherein each of said feeding steps includes conveying the respective cover past an adhesive applying station and coating one side of the conveyed cover with adhesive at the adhesive applying station.

21. Apparatus for making books from back strips, covers and piles with each pile composed of a plurality of overlapping sheets having a size several times that of a book page, comprising means for transporting successive piles of a series of piles along at least one elongated path; means for connecting the sheets of each of said series of piles to each other in at least one first portion of said at least one path; means for folding the connected sheets of successive piles of the series in at least one second portion of the at least one path to convert each pile into a folded pile having a spine and two outermost sheets; means for adhesively securing the outermost sheets of successive folded piles to covers in at least one third portion of the at least one path; means for adhesively affixing back strips to the spines of successive folded piles in at least one fourth portion of said at least one path; and means for subdividing successive backstripped piles into a plurality of books in at least one fifth portion of said at least one path.

22. The apparatus of claim 21, each of the piles comprising elongated sheets having pairs of parallel long sides, wherein said folding means includes means for folding the sheets of successive piles between and in substantial parallelism with the long sides of the sheets of successive piles.

23. The apparatus of claim 21, wherein said securing means includes at least one source of rigid or semirigid covers.

24. The apparatus of claim 21, each of the piles comprising elongated sheets having pairs of parallel long sides, wherein said connecting means comprises means for sewing rows of threads through successive piles substantially midway between the long sides of the sheets of successive piles, said transporting means comprising means for advancing successive piles in the direction of the long sides of the respective sheets during transport at the at least one first portion of said at least one path.

25. The apparatus of claim 21, each of the piles comprising elongated sheets having pairs of parallel long sides, wherein said folding means includes means for folding successive piles of said series substantially midway between the long sides of the respective sheets, said transporting means including means for advancing successive piles or the series substantially at right angles to the long sides of the respective sheets during transport at the at least one second portion of the at least one path.

26. The apparatus of claim 21, wherein said connecting means includes means for sewing threads through successive piles at the respective spines, and further comprising means for applying adhesive to the spines of folded piles to bond the stitches to the respective sheets in at least one other portion of said path ahead of said at least one fourth portion.

27. The apparatus of claim 21, further comprising means for trimming successive folded piles and the covers secured to the outermost sheets of such folded piles in at least one portion of said at least one path between said at least one third portion and said at least one fifth portion.

28. The apparatus of claim 21, further comprising means for superimposing groups of successive folded piles and means for positioning the thus obtained groups next to each other to form blocks of groups ahead of said at least one fifth portion of said path, said subdividing means comprising means for simultaneously severing the folded piles of successive blocks whereby each block yields elongated files of stacks of books.

29. The apparatus of claim 21 wherein said securing means includes at least one source of covers, means for feeding a first adhesive-coated cover from said at least one source against one outermost sheet of the folded pile in said at least one third portion of said at least one path, means for thereupon inverting the folded pile at the at least one third portion of said path, and means for thereupon feeding a second adhesive-coated cover from said at least one source against the other outermost sheet of the folded pile at the at least one third portion of said at least one path.

30. The apparatus of claim 29, further comprising means for applying an adhesive to one side of each cover which is being fed from said at least one source to an outermost sheet of a folded pile at the at least one third portion of said at least one path.

31. The apparatus of claim 21, further comprising means for compressing successive folded piles and the covers secured thereto between the at least one third and the at least one fifth portion of the at least one path.

32. The apparatus of claim 21, further comprising means for gathering folded piles and the covers adhering thereto into groups of superimposed piles and means for compressing the groups of superimposed folded piles and covers between the at least one third and the at least one fifth portion of said at least one path.

* * * * *